US005715907A

United States Patent [19]

Andret et al.

[11] Patent Number: 5,715,907

[45] Date of Patent: Feb. 10, 1998

[54] ACCESS DEVICE FOR ABOVE-GROUND SWIMMING POOLS

[76] Inventors: Sandra Andret, 4, rue de la Granière, 13011 Marseille; Pascale Andrei-Necco, Chemin de la Carreirade d'Allauch, 13400 Aubagne, both of France

[21] Appl. No.: 685,480

[22] Filed: Jul. 24, 1996

[30] Foreign Application Priority Data

Jul. 25, 1995 [FR] France ..... 95 09332

[51] Int. Cl.[6] ..... E04H 4/12; E06C 7/16

[52] U.S. Cl. ..... 182/118; 182/115

[58] Field of Search ..... 182/82, 93, 97, 182/106, 115, 118, 119, 129, 194; D25/2

[56] References Cited

U.S. PATENT DOCUMENTS

| | | | |
|---|---|---|---|
| 2,962,112 | 11/1960 | Ramsberger et al. | 182/118 |
| 3,036,712 | 5/1962 | Barbara | 210/169 |
| 3,288,248 | 11/1966 | Gurian et al. | 182/118 |
| 3,390,740 | 7/1968 | Brandel et al. | 182/115 |
| 3,586,124 | 6/1971 | Kunzweiler et al. | 182/97 |
| 3,908,795 | 9/1975 | Gannon | 182/118 |
| 4,023,647 | 5/1977 | Confer | 182/118 X |
| 4,599,835 | 7/1986 | Rinke | 52/184 |
| 4,603,758 | 8/1986 | Pettit | 182/118 X |

FOREIGN PATENT DOCUMENTS

| | | |
|---|---|---|
| 3402877 | 9/1979 | Australia . |
| 394240 | 2/1992 | Austria . |
| 0460984 | 12/1991 | European Pat. Off. . |

*Primary Examiner*—Alvin C. Chin-Shue
*Assistant Examiner*—Long Dinh Phan
*Attorney, Agent, or Firm*—Dvorak & Orum

[57] ABSTRACT

The present invention relates to a device for giving access, more particularly for use in an above-ground swimming pool. The device comprises a stair and a ladder, together with two hand rails. The stair is mainly constituted by a hollow body having steps incorporated in the walls thereof. The ladder is mainly constituted by a hollow body with steps incorporated in the walls thereof. Each of the hand rails is fixed to each of the hollow bodies via at least two points. The technical field of the invention is that of manufacturing access devices for swimming pools.

9 Claims, 2 Drawing Sheets

ACCESS DEVICE FOR ABOVE-GROUND SWIMMING POOLS

FIELD OF THE INVENTION

The present invention relates to an access device intended in particular for use with above-ground swimming pools.

The technical field of the invention is that of manufacturing access devices for swimming pools.

In the present application, the term "above-ground swimming pool" is used as a general term to designate any swimming pool (usually one suitable for being disassembled) that is essentially constituted by a flat bottom of flexible plastics material connected at its periphery to side walls of the pool, which side walls are substantially vertical and likewise flexible or semirigid, with such a pool being designed to be placed on the ground.

BACKGROUND OF THE INVENTION

Patent FR 2 554 857 (DESJOYAUX et al.) already discloses a compact service block for a swimming pool, which block includes a front portion designed to be immersed against the inside vertical wall of the pool, and a back portion designed to be placed on the coping of the pool; the immersed front portion of the compact block contains steps constituting a ladder (or a stair) for accessing (or climbing down into) the inside of the pool; the compact block includes a filter unit in its rear portion.

OBJECT AND SUMMARY OF THE INVENTION

The object of the invention is to improve swimming pool access devices as described in the above-mentioned patent, and to adapt them to the particular case of above-ground pools for which the device described in the above-mentioned document is incapable of being used.

The solution to the problem posed consists in providing a device for access to an above-ground swimming pool, the device comprising an (outside) stair and an (inside) ladder, together with two hand rails or bannisters or guards, wherein each of the rails is fixed to each of said stair and said ladder at at least two points.

In preferred embodiments:

said stair is mainly constituted (e.g. as a single piece) by a hollow body (preferably of plastics material, e.g. fiber glass reinforced polyester) with steps being formed in the walls thereof (preferably together with risers);

said ladder is mainly constituted (e.g. as a single piece) by a hollow body (preferably of plastics material) with steps incorporated in the walls thereof (preferably together with risers);

the means for fixing bannisters to the hollow bodies comprise nut-and-bolt fasteners of which one portion (the bolt or the nut) can be constituted by an insert embedded in the wall of the hollow body;

each of said hollow bodies has a substantially horizontal top face forming a portion of a landing connecting the stair to the ladder, and suitable for extending over the top edge of the peripheral wall of the swimming pool, and in which each of said hand rails includes a horizontal tubular linking portion which is fixed via at least one fixing point (or means) to said stair hollow body and which is fixed via at least one fixing point (or means) to said ladder hollow body;

each hand rail is constituted by a generally U-shaped curved tubular element whose two arms are connected together by said horizontal tubular link element, with the ends of said branches being fixed to respective ones of said hollow bodies;

each hand rail includes a horizontal top portion that is substantially parallel to the tubular link element;

the end of each branch of the hand rail is "pinched" or bent to form an angle relative to the horizontal plane lying in the range 10° to 80°, and preferably lying in the range 20° to 70°, with said end being received in a setback provided in a substantially vertical side wall of the corresponding hollow body;

the device of the invention includes a suction orifice and a delivery orifice integrated in or fixed to a (preferably side) wall of the hollow body of the portion of the device that constitutes the ladder;

said device includes an inspection hatch provided in one of the walls of the hollow body in which the steps of the stair are formed (and preferably in one of its substantially vertical side walls);

a cavity defined by the walls of the hollow body that includes the steps of the stair serves to receive a filter, a pump, and valves for a water filtering circuit of the swimming pool; and the device of the invention includes means for passing tubular suction and delivery pipework beneath the landing of the device (situated near the top thereof), and over the peripheral wall of the swimming pool, thereby connecting the suction and delivery orifices (which are integrated in the hollow body for placing inside the pool) to a device for filtering and treating water which is provided inside the stair-forming hollow body (which is disposed outside the pool).

Because of the special characteristics of the invention, a device is made available for giving access to above-ground swimming pools, which device is highly stable and thus provides complete safety for users entering and leaving the pool because of the stability of the assembly which is essentially constituted by two hollow blocks interconnected by the hand rails and by the stiffness of the link means between its subassemblies.

Because of the invention, the two hand rails provide a rigid link between the stair and the ladder, in the manner of a lockable clip or clamp.

Also, because of the special design of the device as two blocks capable of standing one outside the pool on the ground and the other inside the pool on the bottom thereof (which is at substantially the same level as the ground outside the pool), and because of the link means between the two hollow blocks serving as the inside ladder and as the outside stair, an access device is provided that is very simple, cheap to manufacture, and capable of being adapted easily to above-ground swimming pools, in particular pools that are circular in outline.

The device of the invention is advantageously used to protect the equipment used for filtering and treating the water of the pool against bad weather, and it makes it possible to eliminate or to greatly simplify the installation of the coupling pipework required by the system for treating the water of the pool.

Preferably, when seen in plan view, the gap provided between the inside faces of the hollow blocks constituting firstly the outside stair and secondly the ladder inside the pool extends along a path that is curvilinear (and preferably more particularly along an arc of a circle) enabling it to match to within a few centimeters the outline and/or the side or peripheral wall of the above-ground swimming pool.

BRIEF DESCRIPTION OF THE DRAWINGS

The numerous advantages provided by the invention will be better understood from the following description which makes reference to the accompanying drawings which show preferred, but non-limiting, embodiment of the device of the invention.

MORE DETAILED DESCRIPTION

Figure 1:
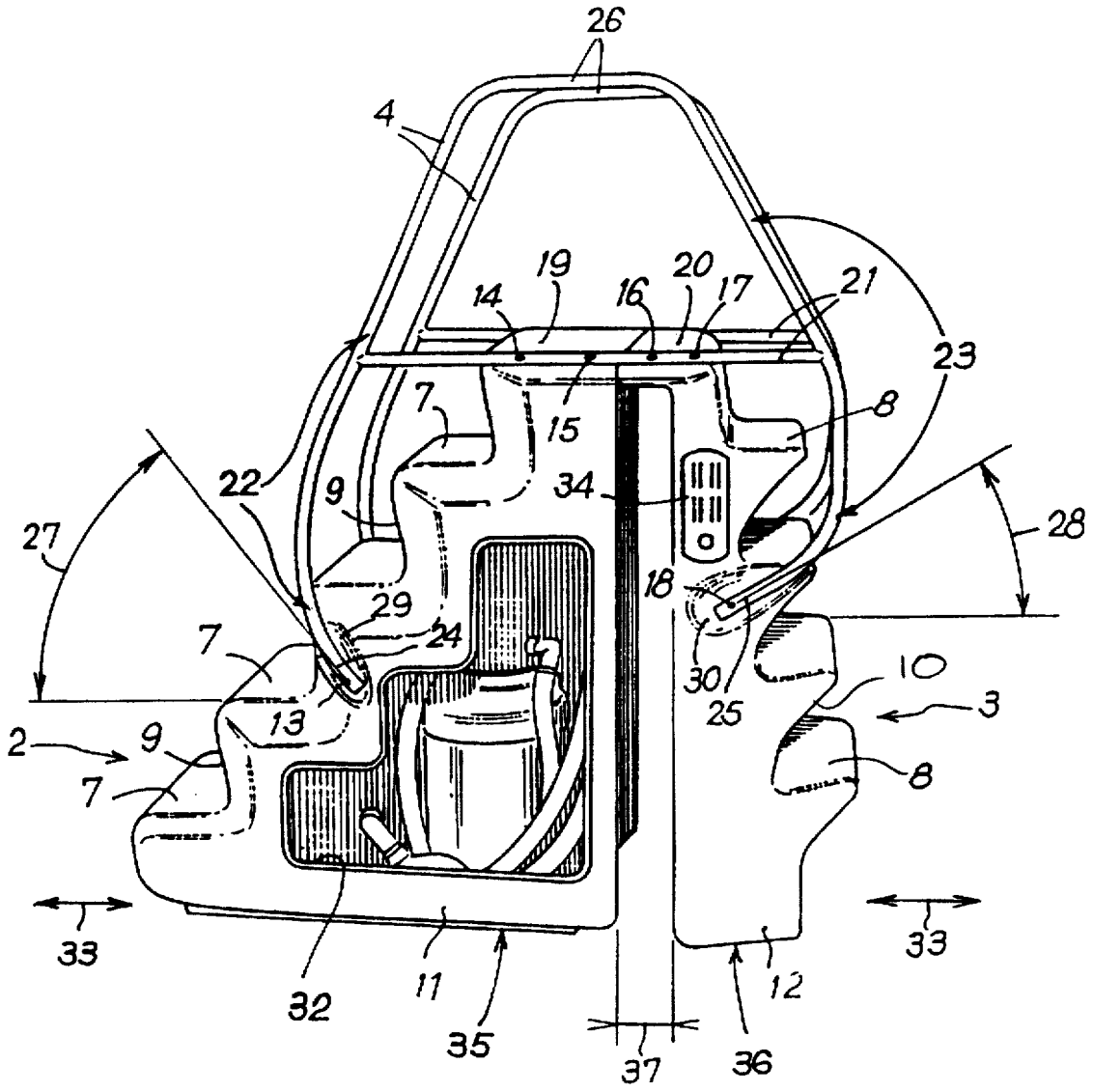
FIG. 1 is a side view of a swimming pool access device shown separate from a swimming pool.

With reference to the figures, it can be seen that the device 5 for access to the above-ground swimming pool 1 of circular outline comprises a stair 2 for situating outside the lateral or peripheral wall 6 of the pool 1 and also comprising a ladder 3 for placing inside the pool, and suitable for resting on the bottom thereof, the stair and the ladder being interconnected by two hand rails or bannisters 4.

The stair 2 is made up of steps 7 interconnected by risers 9 which are integrally formed in a hollow body 11, e.g. a molding of plastics material, and at the top thereof there is a horizontal face 19 forming a portion of a landing suitable for being aligned with a corresponding portion 20 constituting the top face of the hollow block 12 in which there are provided steps 8 and risers 10 of a ladder for access to and climbing down into the inside of the pool.

Figure 3:
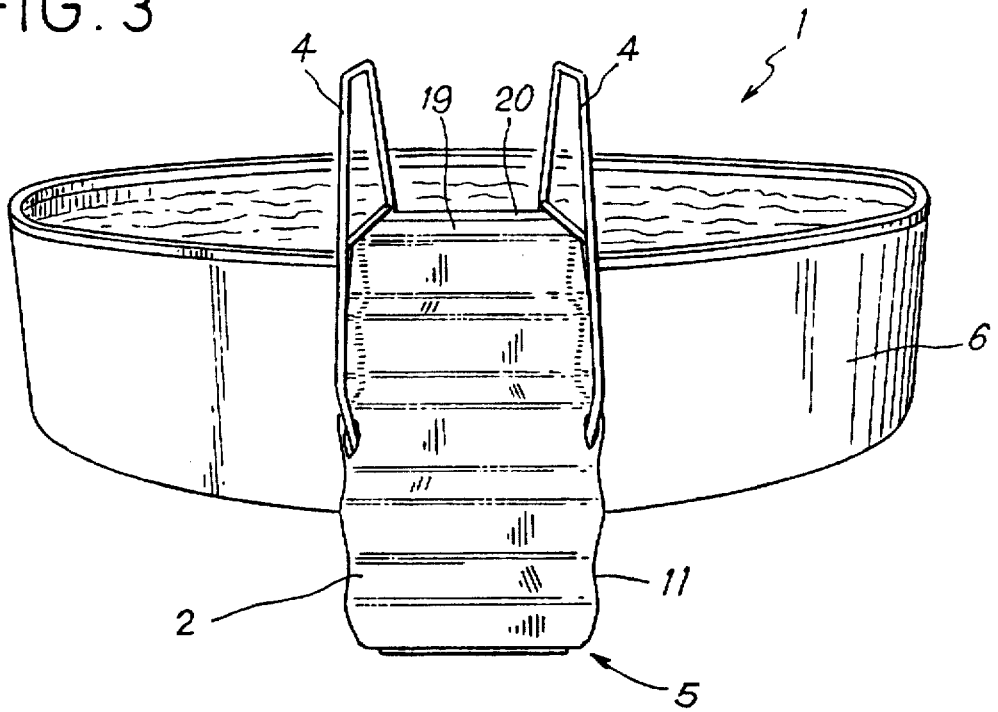
FIG. 3 is a front view of the device shown in FIGS. 1 and 2, in position ready for use with an above-ground swimming pool of circular shape.
Figure 2:
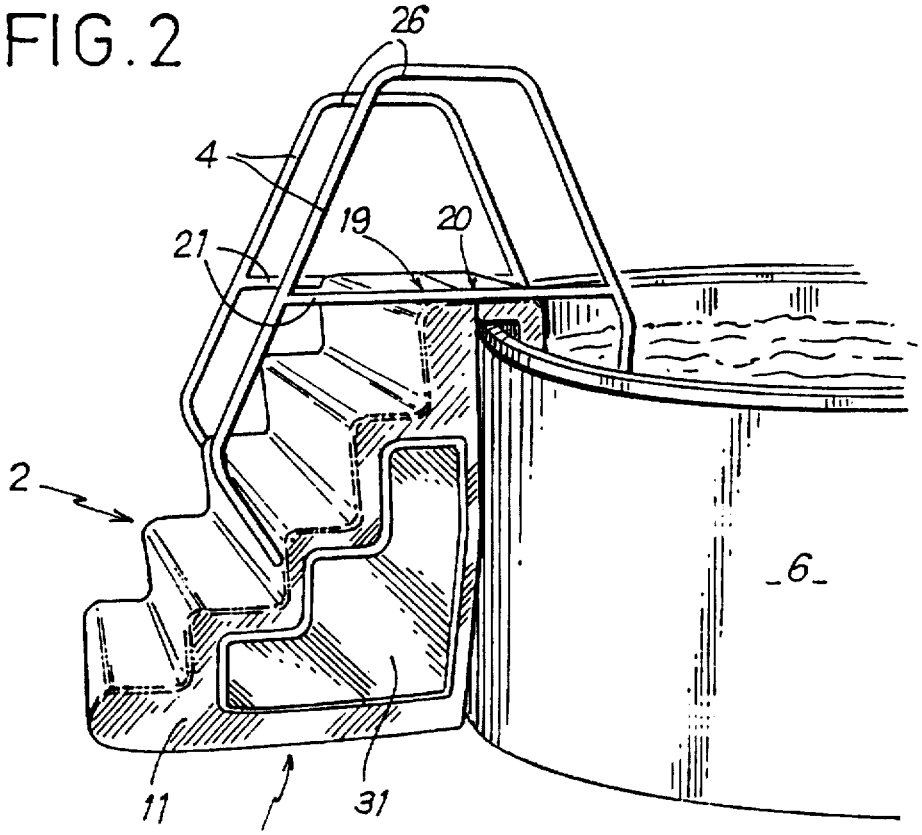
FIG. 2 is a side view of a device identical to that of FIG. 1 but put in place astride the side wall of an above-ground swimming pool that is circular in shape.

In the configurations shown in FIGS. 2 and 3, the access device rests firstly on the base (reference 35 in FIG. 1) of the hollow body 11 in which the steps of the stair are formed and which is situated outside the wall 6 of the pool, and secondly by the base (reference 36 in FIG. 1) of the hollow body 12 in which there are formed the steps 8 and the risers 10 forming the access ladder situated inside the wall of the swimming pool.

Between the stair-forming hollow body 11 and the ladder-forming hollow body 12, and as shown more particularly in FIG. 1, there is provided a narrow space 37 that extends vertically over a height that is greater than the height of the wall 6 of the pool, so as to enable the device shown in FIG. 1 to be placed astride the side wall of the pool.

As shown more particularly in FIG. 1, each of the bannisters 4 has a rectilinear tubular portion 21 extending horizontally along the landing formed by the top walls 19 and 20 of the hollow blocks 11 and 12 respectively, running along the sides of the landing and fixed to said hollow block portions via respective pairs of fixing points 14, 15, and 16, 17.

Each of the bannisters 4 also includes a generally U-shaped tubular portion having a top central portion 26 extended by an angled portion forming two branches 22 and 23 which are rigidly connected in their middle portions to the ends of the tubular element 21 so as to constitute a rigid assembly. The respective ends 24 and 25 of the branches 22 and 23 are fixed via respective third fixing points 13 and 18 to the side walls of the hollow blocks 11 and 12 respectively, and more particularly they are fixed thereto in zones of said side walls where setbacks 29 and 30 are provided of shapes adapted to the ends 24 and 25 of the branches 22 and 23 so as to prevent them from standing out, as can be seen clearly, in particularly in FIG. 3.

As can be seen in the figures, the hand rails 4, which are preferably made of metal, extend in two parallel vertical planes.

As shown in FIG. 1, the end portions of the branches 22 and 23 of each of the rails which are identical and disposed on either side of the device as shown in FIG. 3, in particular, are inclined relative to the horizontal by respective angles 27 and 28 that are preferably greater than 10°, e.g. being in the vicinity of 45° to 60°.

As can also be seen in FIGS. 1 and 2, the hollow block 11 in which the steps 7 of the stair 2 are formed and which is intended to be situated outside the wall 6 of the pool, defines a cavity within which elements such as the pumps, filters, and valves, in particular, of a water filtering circuit can be lodged, which elements also include pipework connecting said filter circuit elements to an opening 34 for sucking water from the pool as provided in one of the side walls of the hollow block 12 in which the ladder is formed, as can be seen in FIG. 1, thereby enabling water to be sucked from the pool, and to circulate through the filter group via pipework (not shown) connecting the suction orifice 34 of the filter group and passing beneath the landing-forming top faces (19, 20, FIG. 1) of the blocks 11 and 12 and over the top portion of the swimming pool wall 6, and similarly pipework is also provided to allow water to circulate from the filter group to a delivery orifice (not shown) likewise integrated in the side walls of the hollow block 12 (in which the steps 8 of the ladder 3 are formed).

As can be seen clearly in FIGS. 1 to 3, the special structure and rigidity of the banisters 4 makes it possible to provide an assembly that is stable and rigid for the access device as a whole, and makes it possible in particular to avoid any movement (horizontal sliding along arrows 33) of the bases of the hollow blocks 11 and 12 which could be harmful to stability and safety of use of the device.

Great rigidity is achieved in particular from the fixing points 14 to 17 being close to one another and to the mechanical junction face between the landings of the stair and of the ladder (which junction face is close to vertically above the vertical side wall of the pool).

What is claimed is:

1. A device for access to an above-ground swimming pool, the device comprising a stair and a ladder, together with two hand rails, in which each of the hand rails is fixed at at least two points to the stair and at at least two points to the ladder, said stair is comprised of a first hollow body having steps incorporated in the walls thereof, and said walls defining a cavity receiving a water filtering circuit for the swimming pool, said filtering circuit including a filter, pump and valves.

2. The device according to claim 1, in which each hand rail has two branches held together by a tubular link element, each of said branches having a pair of ends, which said ends are fixed respectively to said stair and to said ladder.

3. The device according to claim 1, in which said ladder is comprised of a second hollow body having steps incorporated in the walls thereof.

4. The device according to claim 3, in which each of said first and second hollow bodies has a substantially horizontal top face forming a portion of a linking landing between the stair and the ladder, and in which each of said hand rails includes a horizontal tubular link portion which is fixed by at least one fixing means to said first hollow body and by at least one fixing means to said second hollow body.

5. The device according to claim 2, in which each hand rail includes a horizontal top portion disposed substantially parallel to the tubular link element.

6. The device according to claim 3, in which the ends of each of the branches of the hand rail form respective angles with respect to a horizontal plane and wherein said side walls of said first and second hollow bodies include setbacks therein, said angles in the range of 10° to 80°, and in which said ends are received in said setbacks of said first and second hollow bodies.

7. The device according to claim 3, including a suction orifice and a delivery orifice, which said orifices are fixed to a wall of said second hollow body, and wherein at least one of the side walls of said first hollow body includes an inspection hatch.

8. The device according to claim 3, wherein said angles are in the range of 20° to 70°.

9. A device for access to an above-ground swimming pool, the device comprising a stair and a ladder, together with two hand rails, in which each of the hand rails is fixed at at least two points to the stair and at at least two points to the ladder, said stair comprised of a first hollow body having steps incorporated in the walls thereof, said walls defining a cavity which receives a water filtering circuit for the swimming pool, said circuit having a filter, a pump and valves, wherein each hand rail has two branches held together by a tubular link element, each of said branches having a pair of ends, which said ends are fixed respectively to said stair and to said ladder, the ends of each of the branches of the hand rail forming respective angles with respect to a horizontal plane, said angles in the range of 10° to 80°, and in which said ends are received in setbacks provided in the substantially vertical side walls of said first and second hollow bodies, each of said hand rails includes a horizontal top portion substantially parallel to the tubular link element, said ladder comprised of a second hollow body having steps incorporated in the walls thereof wherein each of said first and second hollow bodies has a substantially horizontal top face forming a portion of a linking landing between the stair and the ladder, and in which each of said hand rails includes a horizontal tubular link portion which is fixed by at least one fixing means to said first hollow body and by at least one fixing means to said second hollow body.

* * * * *